US005594805A

United States Patent [19]

Sakamoto et al.

[11] Patent Number: 5,594,805

[45] Date of Patent: Jan. 14, 1997

[54] LOUDSPEAKER

[75] Inventors: Yoshio Sakamoto, Hachioji; Shiro Iwakura, Hamura; Akio Tanase, Hachioji; Kaoru Yamazaki, Akigawa, all of Japan

[73] Assignee: Kabushiki Kaisha Kenwood, Tokyo, Japan

[21] Appl. No.: 515,331

[22] Filed: Aug. 15, 1995

Related U.S. Application Data

[62] Division of Ser. No. 146,116, filed as PCT/JP93/00401, Mar. 31, 1993.

[30] Foreign Application Priority Data

Mar. 31, 1992 [JP] Japan ..... 4-26566
Nov. 30, 1992 [JP] Japan ..... 4-88156

[51] Int. Cl.[6] ..... H04R 75/00

[52] U.S. Cl. ..... 381/199; 381/194; 381/204

[58] Field of Search ..... 381/199, 205, 381/188, 194, 204, 195, 192, 201, 197; 181/161, 171, 172

[56] References Cited

U.S. PATENT DOCUMENTS 4,868,882 9/1989 Ziegenberg et al. ..... 381/200
5,087,300 2/1992 Takayama et al. ..... 381/200

FOREIGN PATENT DOCUMENTS 1928118 6/1969 Germany .
3730305 3/1989 Germany .
59-148500 2/1983 Japan .
2137047 9/1984 United Kingdom .

OTHER PUBLICATIONS

"JP, B1, 45–7590 (Taiichi Sawada)" Mar. 16, 1970.

*Primary Examiner*—Sinh Tran
*Attorney, Agent, or Firm*—Sixbey, Friedman, Leedom & Ferguson, P.C.; Gerald J. Ferguson, Jr.; Karlton C. Butts

[57] ABSTRACT

A loudspeaker capable of improving the efficiency, providing a high performance, and reducing its weight. In a general loudspeaker or a loudspeaker having a repulsion magnetic field type magnetic circuit, the whole or part of the voice coil 1 uses a composite wire A formed by a conductive wire made of conductive material C and a magnetic material F provided at least partially on the surface of the conductive wire, or a composite wire A formed by a magnetic wire made of magnetic material F and a conductive material C provided at least partially on the surface of the magnetic wire.

2 Claims, 15 Drawing Sheets

LOUDSPEAKER

This is a divisional application of Ser. No. 08/146,116, filed as PCT/JP93/00401, Mar. 31, 1993.

INDUSTRIAL APPLICATION FIELD

The present invention relates to a loudspeaker, and more particularly to a loudspeaker of a high efficiency and light in weight.

CONVENTIONAL TECHNIQUE

As shown in FIGS. 22 and 23, conventional general loudspeakers have a magnetic circuit formed by a yoke Y, a single magnet M, and a top plate TP, and a voice coil 1 mounted in a magnetic gap G of the magnetic circuit. In FIGS. 22 and 23, reference numeral 11 represents a voice coil bobbin, reference numeral 2 represents a vibrating plate, reference numeral 3 represents a damper, reference numeral 5 represents a frame, and reference numeral 7 represents a dust cap. In FIG. 23, a wither (vibrating plate for middle and high frequency sounds) is mounted above a neck 21 of the cone vibrating plate 2.

In such conventional general loudspeakers, conductive material C such as a copper wire has been used for a voice coil. Various loudspeakers with different voice coil wire materials have been proposed to improve the magnetic efficiency. For example, in a voice coil proposed in Japanese Utility Model Laid-open Publication No. 60-155296, as shown in FIG. 24, a flat wire of magnetic material F is wound abut a voice coil bobbin 11, and a round wire of non-magnetic material (conductive material) C is wound about the outer circumference of the flat wire. With this structure, magnetic fluxes from a magnet M become likely to pass through the magnetic gap between a yoke Y and top plate TP, because of the presence of the magnetic material F. The magnetic gap is apparently reduced by the amount corresponding to the width of the magnetic material F, improving the efficiency of the loudspeaker. In a voice coil proposed in Japanese Utility Model Publication No. 49-28920, as shown in FIG. 25, powders of magnetic material F are mixed in conductive material C, and used for the manufacture of a voice coil wire.

Many loudspeakers intended to make them compact, thin, light in weight, and so on have been proposed in which two magnets magnetized in the direction of thickness are mounted with the same polarities facing each other, and a voice coil to be driven is mounted in the repulsion magnetic field at the magnetic gap between the two magnets. Such loudspeakers are described, for example, in Japanese Patent Laid-open Publications No. 59-148500 and No. 1-98400. The structures of voice coils relative to the repulsion magnetic field are shown in FIGS. 25 and 26 respectively for the Publications No. 59-148500 and No. 1-98400. In FIGS. 25 and 26, M1 and M2 represent magnets, P represents a center plate disposed between the magnets, reference numeral 1 represents a voice coil, and reference numeral 11 represents a coil bobbin.

In the voice coil of the loudspeaker shown in FIG. 24, the magnetic wire of the magnetic material F and the conductive wire of the conductive material C are wound about the voice coil bobbin 11. The coefficient of thermal expansion of the conductive material C is far greater than that of the magnetic material F. Therefore, this voice coil has the disadvantage that the whole part of the adhesive which bends the magnetic wire and conductive wire together, and the outermost and innermost magnetic and conductive wires, are likely to be peeled off.

In a loudspeaker having a voice coil made of a conductive material C only, it is well known that the temperature of the voice coil rises to 200° to 300 ° C. while driving it with a sound signal. The electric conductivity of the magnetic material F is very low as compared to that of the conductive material. Heat is generated greatly from the magnetic material driven with a sound signal so that the problem of the peel-off by a difference between coefficients of thermal expansion becomes conspicuous. The heat dissipation effect of the conductive material C is greater than the magnetic material F. Even if the conductive wire having the heat dissipation effect is disposed on the outer side of the voice coil such as shown in FIGS. 24, the temperature of the voice coil is very high as compared to an ordinary voice coil, so that the heat dissipation effect of the conductive wire cannot compensate for the temperature rise.

Because of a great difference of conductivity between the magnetic material F and conductive material C, it is difficult to improve the quality of sounds of a loudspeaker. It is conceivable to make both the conductivities same by adjusting the diameters or the like of the magnetic wire and conductive wire. In this case, however, the diameters become very different and both the wires become more easy to be peeled off, resulting in a difficulty of practical use as a loudspeaker.

The most serious problem of the loudspeaker shown in FIG. 25 is that the resistance of the voice coil increases and heat is generated considerably, because the magnetic material F is mixed with the conductive material. Furthermore, the voice coil wire of this type is very difficult to manufacture. Specifically, a very fine voice coil wire in the order of 0.3 mm in diameter is generally used. In manufacturing such a fine wire, a relatively thick wire is first formed, and then this wire is extruded into a fine wire. However, in the case of the voice coil wire such as shown in FIG. 25, powders of the magnetic material are trapped by the edge of a wire outlet of the extruder while extruding the wire, and there is a fear of breaking the wire.

As a method of mixing powders of the magnetic material F with the conductive material, powders of the magnetic material F are mixed with melted conductive material C and thereafter they area agitated, or powders of the conductive material C and powders of magnetic material F are mixed and agitated, and thereafter they are pressed into a powder mold. In both methods, it is very difficult to manufacture a voice coil wire because the conductive material C and magnetic material F of different specific gravities are difficult to be agitated uniformly at a high precision.

Still further, the agitation process results in a contact of the material with oxygen, producing oxide. It is therefore difficult to maintain the quality of the voice coil wire sufficient for practical use. This problem may be solved by performing the agitation process under argon or vacuum atmosphere. However, this poses the problem of a large increase in cost for manufacturing facilities or the like.

The loudspeaker shown in FIG. 25 is practically very difficult to manufacture, because of poor mass productivity, a difficulty of maintaining a high quality, and a very high cost.

In the loudspeaker shown in FIG. 26, the voice coil 1 uses only the general conductive material C such as copper wires. It is therefore difficult to efficiently transmit the magnetic field necessary for driving the voice coil 1. Namely, the width of magnetic fluxes generated by the repulsion magnetic field structure is very narrow. In order to obtain the desired width of magnetic fluxes, it is necessary to guide the magnetic field outward of the outer circumference P1 of the center plate P by mounting the outer plate OP of the magnetic material F having a predetermined thickness on the opposite side of the coil relative to the center plate P. Part of the magnetic fluxes guided to the center plate outer circumference P1 flows directly toward the S poles of the magnets M1 and M2 as indicated by broken lines. Most of the magnetic fluxes will not flow in the direction necessary for driving the voice coil 1, i.e., in the direction intersecting the voice coil 1, resulting in a low efficiency, particularly in a disability of obtaining middle and low frequency sound pressures. It is therefore practically difficult to manufacture a high fidelity loudspeaker.

In the loudspeaker shown in FIG. 27, a tape having a very high permeability, such as an amorphous metal tape Fa, is wound about the outer circumference 12 of the voice coil. As a result, magnetic fluxes will easily flow in the direction of intersecting the coil wire as indicated by broken lines. However, the amorphous metal tape Fa is located at the outermost circumference 12 of the voice coil 1, i.e., at the position remotest from the outer circumference P1 of the center plate P from which magnetic fluxes come most.

As well known, magnetic fluxes are weakened as the distance from the magnet becomes longer. From this reason, amorphous metal having a high permeability is used to efficiently converge weakened magnetic fluxes. However, the amorphous metal tape Fa and the general coil wire are required for the manufacture of the voice coil, resulting not only in an increased number of components of the voice coil 1, but also in a high cost and low availability of the amorphous metal tape Fa as compared to general soft magnetic material such as iron and Permalloy.

Still further, the amorphous metal tape Fa has generally a high elastic modulus so that it is difficult to curve and curl it and maintain a curled shape matching the outer circumference of the voice coil 1. Accordingly, in attaching the amorphous metal tape Fa to the coil wire outer circumference by using an adhesive agent or the like, it becomes necessary to hold it until the adhesive agent becomes cured, resulting in an increased number of bonding processes and complicated works. Moreover, the ends of the amorphous metal tape Fa even after being bonded are likely to be lifted up. If a fixing band or additional adhesive is used to prevent this lift-up, the weight of the voice coil 1 increases and the efficiency is degraded. Also in the loudspeaker shown in FIG. 27, the diameter of the outer circumference P1 of the center plate P is set smaller than that of the magnets M1 and M2. As a result, the amount of magnetic fluxes generated from the center plate P outer circumference is less, degrading the efficiency.

It is therefore an object of the present invention to eliminate the above-described disadvantages of conventional loudspeakers, and to provide a loudspeaker capable of considerably improving the efficiency while providing a high performance and reducing the weight.

SUMMARY OF THE INVENTION

According to the present invention, the whole or part of the voice coil of a loudspeaker uses a composite wire formed by a conductive wire core made of conductive material and a magnetic material clad provided at least partially on the surface of the conductive wire core, or a composite wire formed by a magnetic material core made of magnetic material and a conductive material clad provided at least partially on the surface of the magnetic material core.

In another type of the loudspeaker, a plurality of voice coil wires having different materials are wound at the same time to dispose different wires having different materials one turn after another.

A magnetic circuit with a repulsion magnetic field is formed by disposing two magnets magnetized in the direction of thickness with the same polarities facing each other, and a center plate is sandwiched between the two magnets. The voice coil is disposed on the outer side of the center plate in the repulsion magnetic field to drive the vibrating plate by the voice coil. The diameter of the center plate is set greater than that of the magnets.

The voice coil maybe made to have a bobbin-less structure. The vibrating plate made of cone paper or the like, or the suspension such as a damper, may be mounted on the voice coil at the lower or higher end, or at the outer circumference.

A wither may be mounted on the voice coil at the outer circumference above the neck of the vibrating plate made of cone paper. In this case, a chamber or dust cap is mounted on the wither at its apex or at its slanted surface.

A frame-less structure may be used by mounting the magnetic circuit portion and vibrating plate directly on the loudspeaker grille or the punched plate of the grille.

The whole or part of the voice coil of a loudspeaker uses a composite wire formed by a conductive wire core made of conductive material and a magnetic material clad provided at least partially on the surface of the conductive wire core, or a composite wire formed by a magnetic material core made of magnetic material and a conductive material clad provided at least partially on the surface of the magnetic material core. Accordingly, magnetic fluxes from the magnets pass through the magnetic material, improving the efficiency of the loudspeaker. In addition, the voice coil itself can be reduced in weight.

If a plurality of voice coil wires having different materials are to be wound at the same time to dispose different wires having different materials one turn after another, it is possible to select a desired combination of voice coil wires, to improve the efficiency, and to reduce the weight, while considering the characteristics of the loudspeaker to be manufactured.

If the voice coil is disposed in the magnetic circuit with the repulsion magnetic field, the magnetic material locates on the outer side of the center plate. Accordingly, magnetic fluxes are directed outward from the outer circumference of the center plate and are likely to intersect the coil wire. A sound pressure sufficient .for practical use can be obtained without using a conventional magnetic gap. The loudspeaker can be made lighter in weight and thinner. The problem of the conventional loudspeaker shown in FIG. 26 that the sound pressure particularly at the low and middle frequency range is insufficient for practical use, can be solved and the sound level can be improved over the whole frequency range.

As compared to the conventional loudspeaker shown in FIG. 27, the magnetic material is disposed at the position very near magnetic fluxes, thereby improving the efficiency and reducing the weight of the voice coil. By setting the diameter of the center plate greater by about 1 mm than that of the magnets, magnetic fluxes can be generated efficiently from the outer circumference of the center plate.

If the vibrating plate made of cone paper or the like, or the suspension such as a damper is mounted on the voice coil at the lower or higher end, or at the outer circumference, the loudspeaker can be made thinner. With the bobbin-less structure of the loudspeaker, the weight can be reduced further and a high efficiency can be obtained. By selecting optimum magnetic material and optimum position of magnetic material, the efficiency can be improved further.

In this case, by mounting a wither on the voice coil at the outer circumference above the neck of the vibrating plate made of cone paper and by mounting a chamber or dust cap on the wither at its apex or at its slanted surface, it becomes possible to provide a sufficient stroke of the vibrating plate.

If a frame-less structure is used by mounting the magnetic circuit portion and vibrating plate directly on the loudspeaker grille or the punched plate of the grille, the weight can be reduced further.

EMBODIMENTS

Figure 1:
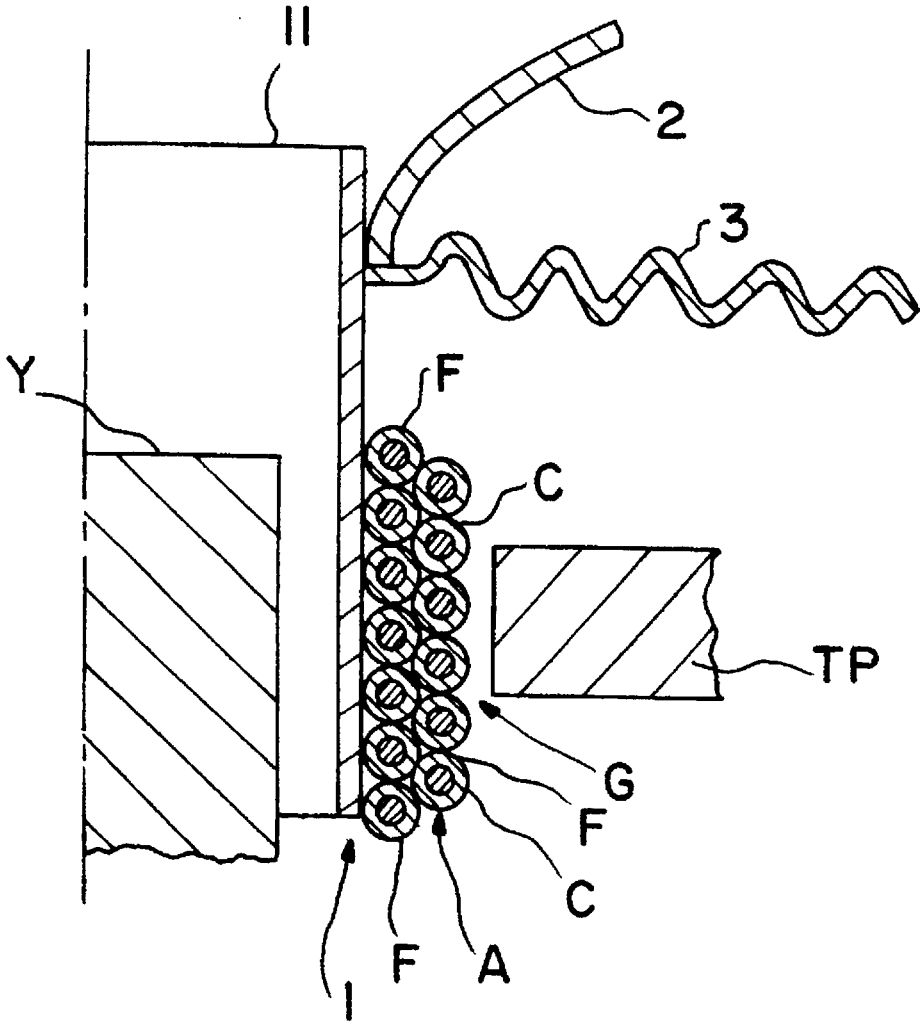
FIG. 1 is a cross sectional view of a loudspeaker according to an embodiment of the present invention.

Embodiments of a loudspeaker according to the present invention will be described with reference to FIGS. 1 to 21. In these Figures, like elements to those described with FIGS. 22 to 27 are designated by using identical reference numerals and characters, and the detailed description thereof is omitted.

Reference character A represents a composite wire formed by a conductive wire made of conductive material C and a magnetic material F provided on the surface of the conductive material wire. For the purpose of simplicity, an insulating film formed on the surface of the outermost voice coil wire is not shown.

Referring to FIG. 1, the composite wire A is wound abut a voice coil bobbin 11 to form a voice coil 1. The voice coil 1 is mounted in the magnetic gap G like the conventional loudspeaker shown in FIG. 23.

Magnetic fluxes from a magnet M are converged and become likely to be transmitted by the magnetic material F of the composite wire A, improving the efficiency of the loudspeaker.

In the embodiment shown in FIG. 1, the conductive material C is used as a core of the composite wire A and the magnetic material F is used as the clad of the conductive material C. It is obvious that the amounts of the conductive material and magnetic material can be adjusted as desired by taking into consideration of the differences of the conductivity and the coefficient of thermal expansion between beth the materials. The composite wire A has a higher conductivity and better heat dissipation effect than those of the magnetic wire made of only the magnetic material F, thereby generating less heat. Accordingly, the difference of the coefficient of thermal expansion between the conductive material C and magnetic material F is not necessary to be considered so much, thereby maintaining the stable state of both the materials.

If the conductive material as the core is designed to have a sufficient conductivity, breaking of the magnetic material F because of the thermal expansion of the conductive material will not pose any problem of the performance and sound quality of the loudspeaker. Also in this case, the magnetic material F will not dismount from the conductive material, posing no problem with respect to the divergence of magnetic fluxes from the magnet M.

A composite wire A may be formed by a magnetic wire made of magnetic material F and a conductive material C provided on the surface of the magnetic material wire. Also in this case, the efficiency of the loudspeaker can be improved. The coefficient of thermal expansion will not pose any problem because the conductive material C having a high coefficient of thermal expansion and high heat dissipation effect is disposed on the outer peripheral area of the composite wire.

A manufacturing process for a composite wire changes with whether or not the amount of magnetic material is controlled to be more than the conductive material. The control of amount can be carried out relatively easily if the material having a larger amount is used as the base material. In the embodiment shown in FIG. 1, the conductive material such as copper is used as the core, and the magnetic material such as Permalloy and iron is used as the clad. The clad was formed by plating to deposit the magnetic material on the copper wire. The method is effective for the case where the amount of the conductive material such as copper is large and the amount of magnetic material is small. The amount of magnetic material to be described later is presently near a limit value. However, the amount of magnetic material can be controlled to a smaller value, e.g., to about 1.5 microns in the case of plating, and to a further smaller value in the case of vapor deposition.

If the amount of magnetic material is made larger, the magnetic material such as iron is used as the base material core, and the conductive material such as copper is used as the clad by means of a dip forming process. This composite wire (hereinafter called iron core wire) can be controlled to have the thickness of the conductive material such as copper about 30 to 80% of the thickness of the iron core wire. As the ratio of copper reduces, the cost of the composite wire reduces. If the thickness of the conductive material is to be further reduced, plating or vapor deposition may be used.

The inventors manufactured an iron core wire having a diameter of 0.3 mm, a ratio of the iron cross section to the copper cross section of 56: 44, and a conductivity of 60%. The iron core wire was extruded by a dice to a diameter of 0.21 mm. By using this iron core wire, a voice coil was made which had a winding width of about 6.5 mm, a d.c. resistance of about 3.4 ohms, and a voice coil inner diameter of 30.4 mm. It was also found that the iron core wire could be extruded to a diameter of about 0.1 mm. It was also found that an iron core wire of 0.23 mm in diameter could be pressed into a flat wire of 0.05 mm*0.9 mm.

Figure 15:
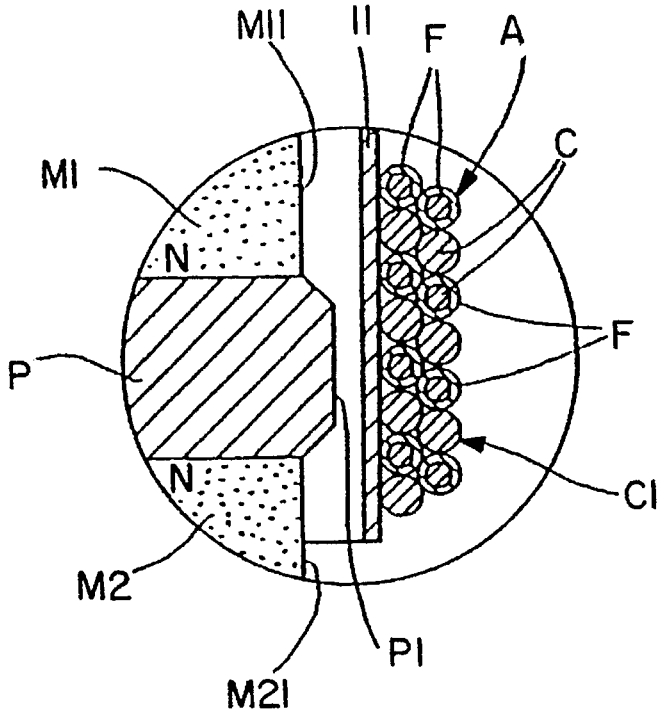
FIG. 15 is an enlarged cross sectional view showing the main part of another voice coil different from that shown in FIG. 14.

In some cases, the iron core wire may be attracted in the magnetic gap or the clogging phenomenon may occur because of the large amount of magnetic material. These phenomena were solved by alternately winding the iron core wire and an aluminum wire having the same diameter one turn after another, as shown in FIG. 15. In this case, the performance of the loudspeaker was improved in part and the rise portion at the low frequency band or the like could be controlled.

On one side of a copper foil having a thickness of 5 to 8 μ, magnetic-material such as iron and Permalloy was plated to the thickness of about 2.5 microns. This foil was cut into stripe wires having a width of 0.8 mm. The stripe wires were subjected to an insulating process to obtain voice coil wires. This stripe wire was used for the loudspeaker shown in FIG. 1 which presented a better performance of the coil.

As a method of manufacturing a composite wire A, any one of the following methods may be selectively used. The methods include an extrusion method wherein a thick rod type conductive material C is provided at its whole surface with melted magnetic material F of a predetermined thickness, and this composite wire is extruded to a thin composite wire, a cladding method wherein magnetic material F is pressed and attached to conductive material C, a coating method wherein magnetic material F is coated on the surface of conductive material C, a vapor deposition method wherein magnetic material F is vapor-deposited on the surface of conductive material C, and other methods. With the extrusion method in particular wherein a thick red composite wire is extruded, the magnetic material F can be formed thick, further improving the property of the finished composite wire.

Figure 2:
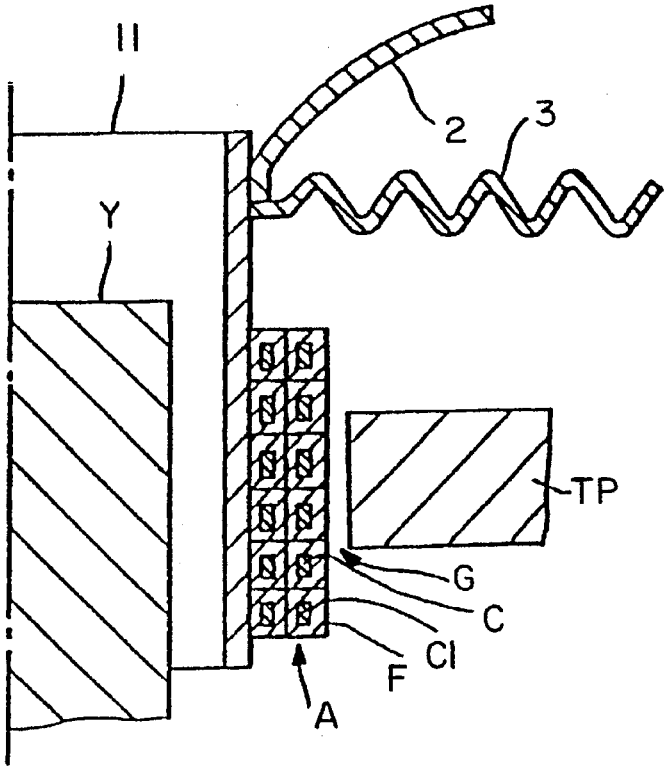
FIG. 2 is a cross sectional view of a loudspeaker according to another embodiment of the present invention.
Figure 3:
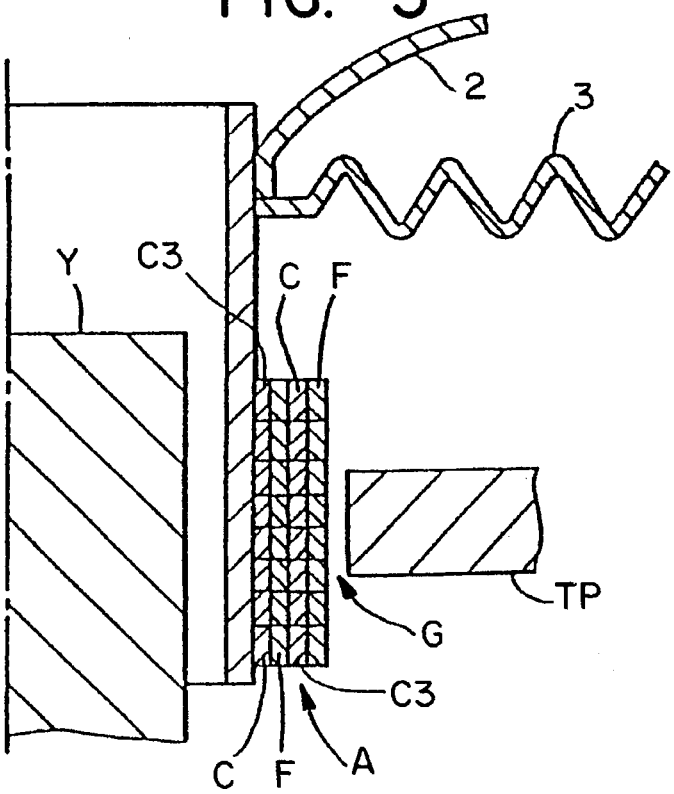
FIG. 3 is a cross sectional view of a loudspeaker according to another embodiment of the present invention.

As the composite wire A used for the voice coil 1, a composite wire shown in FIG. 2 may be used wherein a flat wire C1 made of conductive material C is provided at its whole surface with magnetic material F, or a composite wire shown in FIG. 3 may be used wherein on one side of a foil C3 made of conductive material, magnetic material F is provided, and the foil is cut into stripe wires having a predetermined width which are then subjected to an insulating process. In the latter case, the conductive material C may be not only copper but also aluminum. Any one of the above methods may be selectively used for providing the conductive material C with the magnetic material F.

Figure 4:
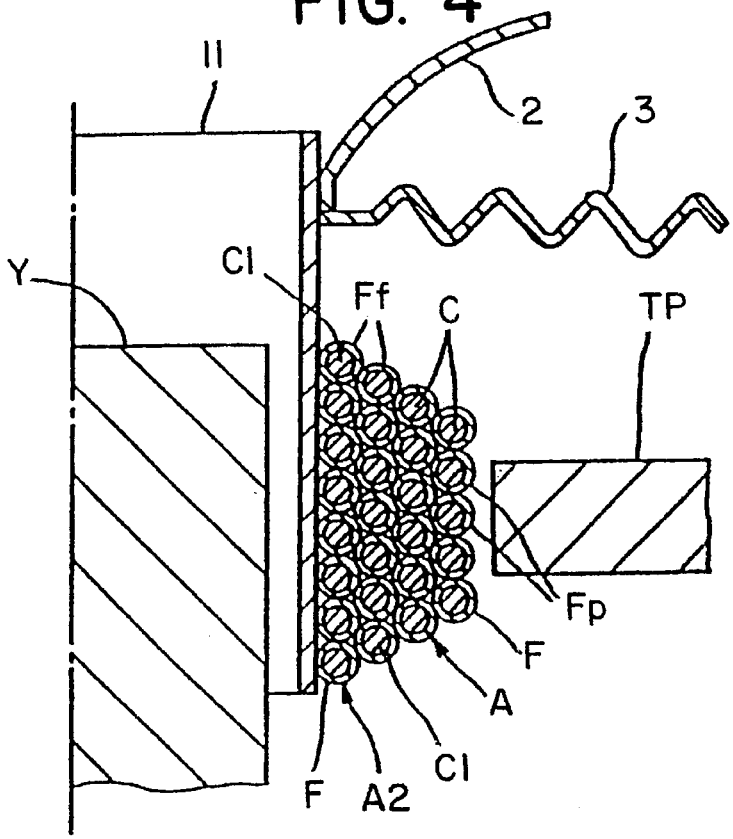
FIG. 4 is a cross sectional view of a loudspeaker having a voice coil with different types of composite wires, according to an embodiment of the present invention.

In accordance with a particular application of a loudspeaker, the structure of the voice coil 1 may be changed. Namely, the voice coil 1 may be formed by using winding layers each having a composite wire A of different magnetic material F. For example, as shown in FIG. 4, a composite wire A formed by a core copper wire C1 and iron Ff as a clad is wound on the first and second winding layers, and another composite wire A formed by a core copper wire C1 and Permalloy Fp as a clad is wound on the third and fourth winding layers.

Figure 5:
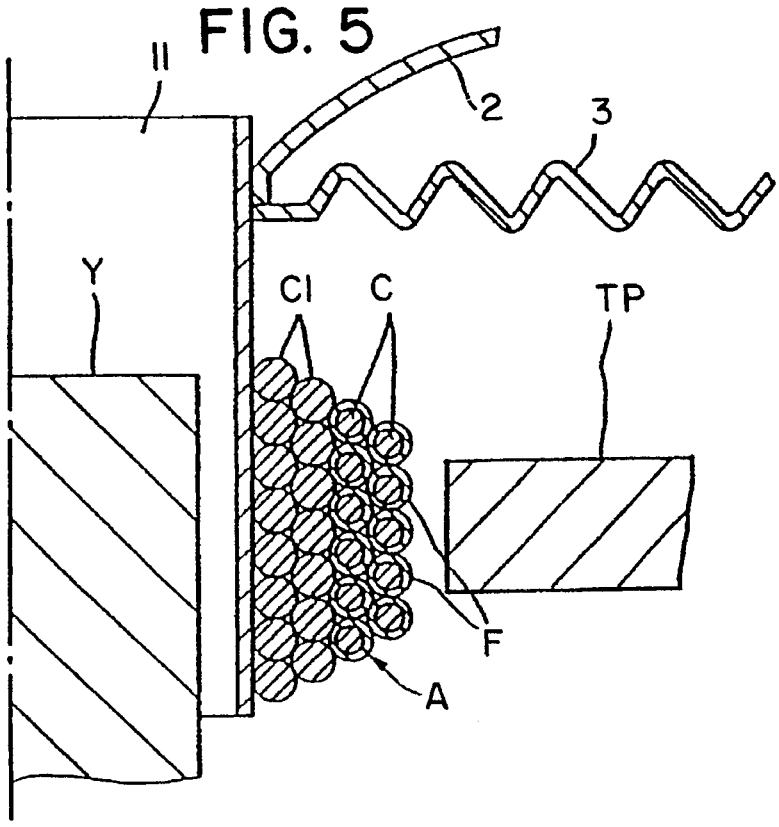
FIG. 5 is a cross sectional view of a loudspeaker having a voice coil with different types of composite wires, according to another embodiment of the present invention.

FIG. 5 shows an example of the voice coil 1 wherein a composite wire A is used partially. A general copper wire C1 is wound on the first and second winding layers, and a composite wire A is wound on the third and fourth winding layers, to complete the voice coil 1. Also in this case, it is obvious that the amounts of conductive material C and magnetic material F can determined as desired while taking into account the conductivity and the coefficient of thermal expansion.

As described previously, the composite wire A has a lower coefficient of thermal expansion than a wire of magnetic material F only. Therefore, even the copper wire C1 and composite wire A are wound on different winding layers, the wires will not be peeled off by a difference of the coefficient of thermal expansion.

Figure 6:
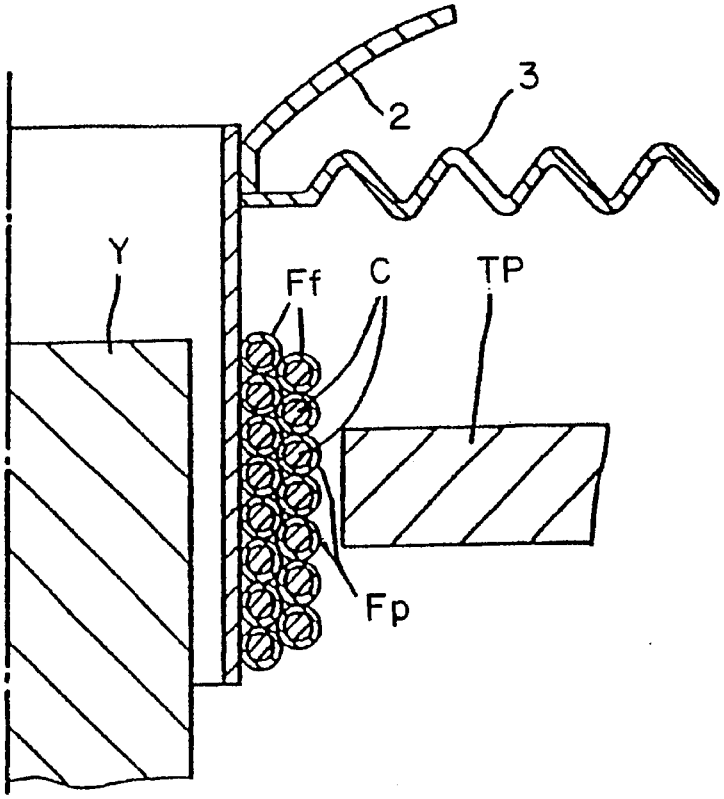
FIG. 6 is a cross sectional view of a loudspeaker having a voice coil with different types of composite wires, according to a further embodiment of the present invention.

FIG. 6 shows another example of the voice coil 1 wherein a plurality of voice coil wires are wound at the same time to dispose different voice coil wires alternately one turn after another. In this example, a composite wire having iron Ff as the magnetic material F and another composite wire having Permalloy Fp as the magnetic material are wound at the same time to dispose different wires alternately one turn after another.

Figure 7:
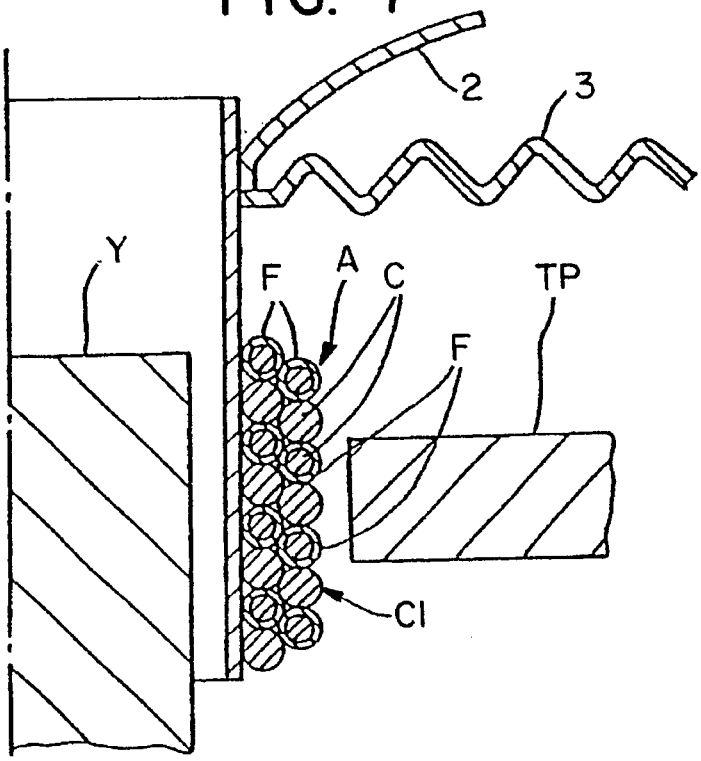
FIG. 7 is a cross sectional view of a loudspeaker having a voice coil with different coil wires being wound alternately one turn after another, according to an embodiment of the present invention.

FIG. 7 shows another example of the voice coil 1 wherein a general wire made of conductive material C and a composite wire A are wound at the same time to dispose different wires alternately one turn after another. A desired combination of voice coil wires is possible, allowing-the loudspeaker to have an improved efficiency and a reduced weight, while considering the final characteristics of the loudspeaker, in the manner described previously.

With the structures described above, the voice coil suitable for a particular loudspeaker can be formed by selecting a combination of wires, without changing the ratio of magnetic material F to conductive material C of a composite wire A, thereby allowing an already manufactured composite wire A to be used optionally.

Next, embodiments of a loudspeaker for a magnetic circuit with a repulsion magnetic field will be described with reference to FIGS. 8 to 21.

Figure 8:
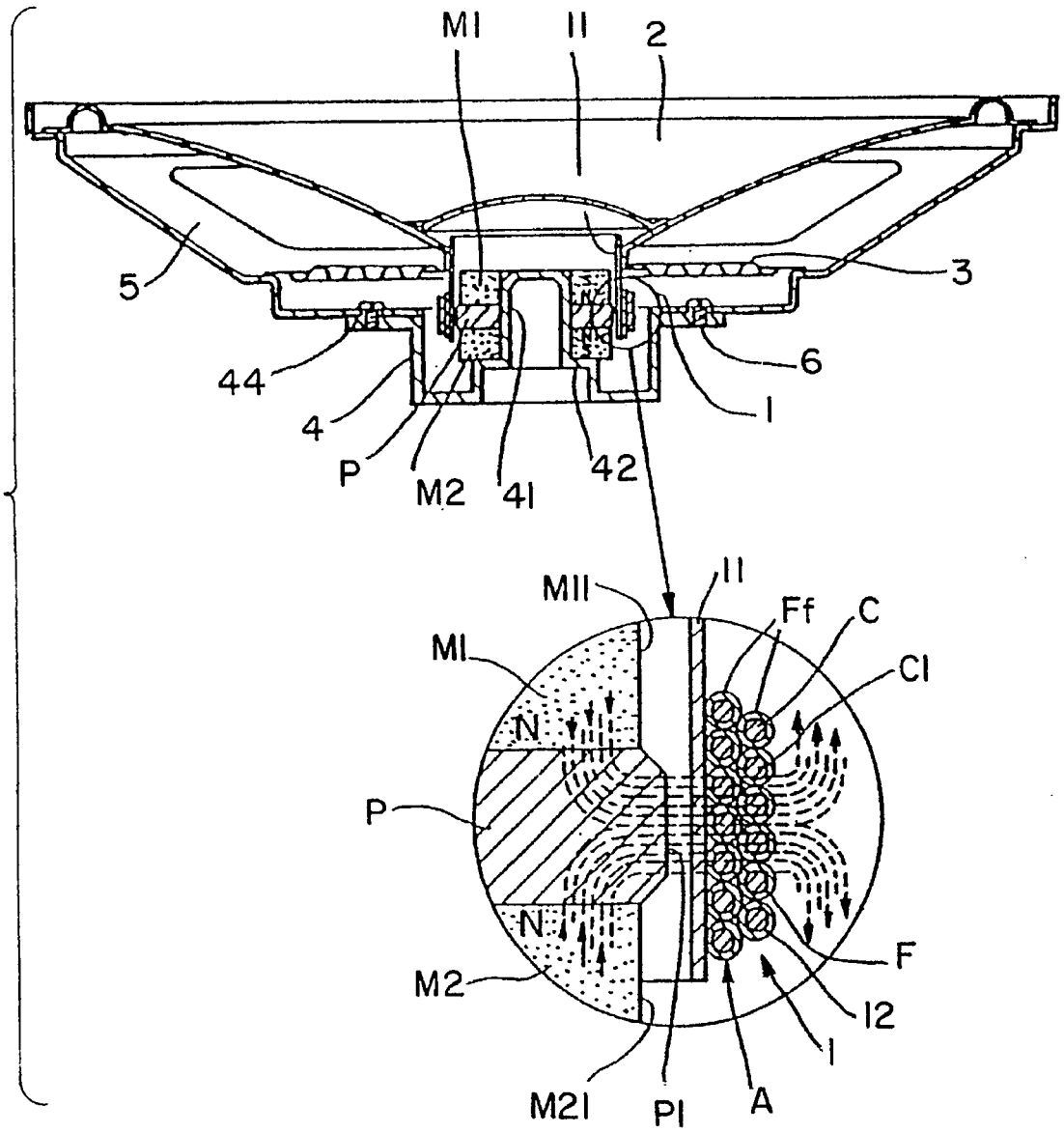
FIG. 8 shows a cross sectional view of a loudspeaker using a repulsion magnetic field according to an embodiment of the present invention, and an enlarged partial cross section of the voice coil.
Figure 9:
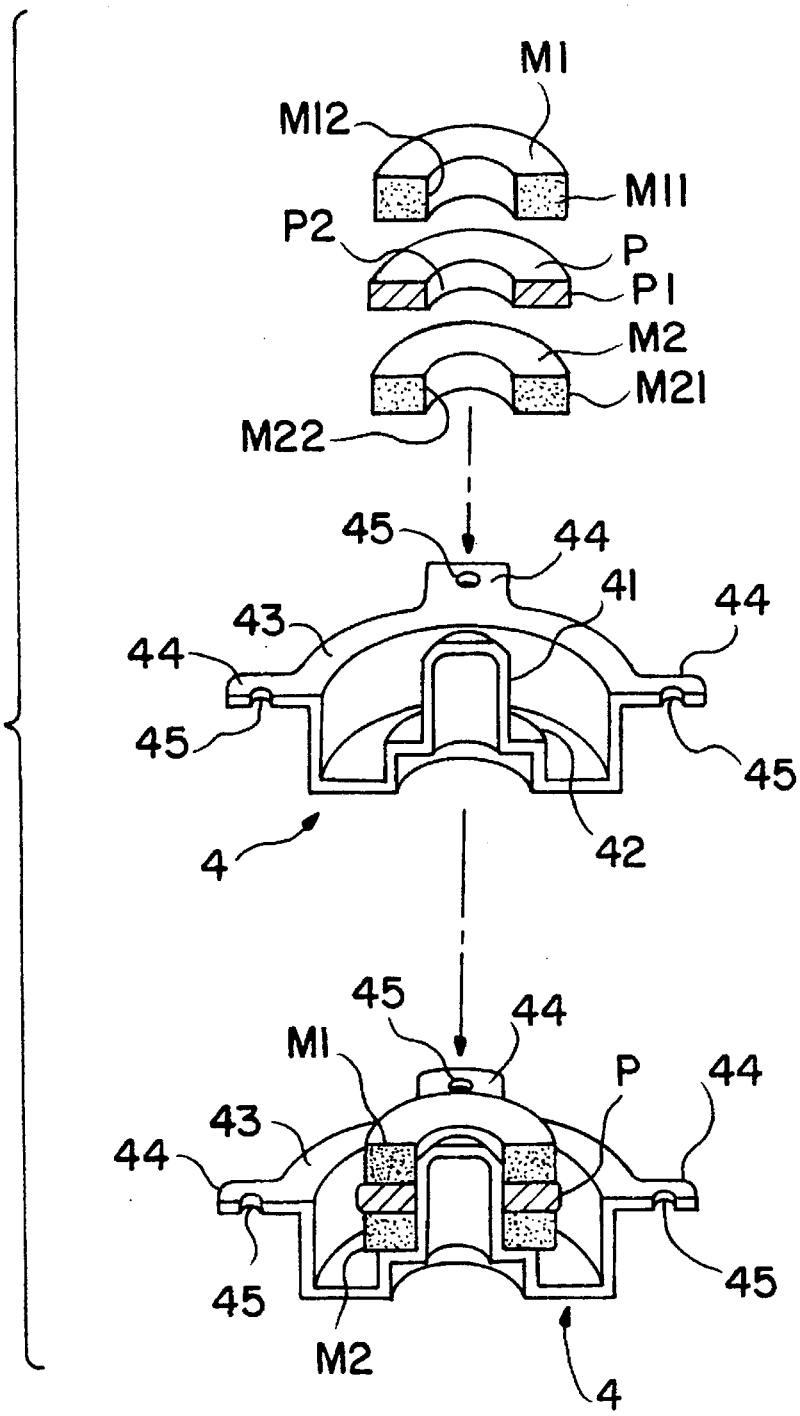
FIG. 9 is a broken perspective view partially in section of the magnetic circuit components of the embodiment loudspeaker shown in FIG. 8.

In the embodiments, magnets M1 and M2 are neodymium magnets magnetized in the direction of thickness, and are of a ring shape with the outer diameter of 29 mm, inner diameter of 12 mm, and thickness of 6 mm. In FIGS. 8 and 9, reference numeral 4 represents a holder for holding the magnets M1 and M2 and a center plate P sandwiched between the magnets M1 and M2. The holder 4 is an aluminum mold and is formed with a cylindrical center guide 41 extending upright from the center of the bottom. A step 42 is formed at the lower area of the center guide 41, the step 42 providing a height alignment function for the magnets M1 and M2 and the center plate P.

Acrylic adhesive agent is coated on the surface of the step 42. The magnet M2 is inserted into the center guide 41 through the inner diameter space M22 by directing the N pole upward. The outer diameter of the center guide 41 was set to 11.95 allowing a smooth insertion of the magnet M2. Adhesive agent is coated on the upper surface of the inserted magnet M2. The center plate P of a ring shape having an outer diameter of 29.95 mm, inner diameter of 11.95 mm, and thickness of 4 mm is then fitted in the inner diameter portion P2 of the center guide 41 downward until the lower surface of the center plate P becomes in tight contact with the N pole surface of the magnet M2. The center plate P is made of ring iron, and the edge portions at the inner diametrical periphery of the center plate P was beveled by C0.4. Adhesive agent is then coated on the upper surface of the fitted center plate P. The magnet M1 is inserted in the center guide 41 through the inner diameter space M12 by directing the N pole downward, until the magnet M1 becomes in tight contact with the upper surface of the center plate P. In this condition, the magnets M1 and M2 with their N poles facing each other interpose the center plate P therebetween, and the center plate outer circumference P1 extends by about 0.5 mm outside of the outer circumferences M11 and M21 of the magnets M1 and M2.

This magnetic circuit on the holder 4 is mounted on a frame 5. To this end, the holder 4 is formed with a flange 43 having a width of about 2 mm and a thickness of 2.5 mm. The flange 43 is formed with four tongue projections 44 extending outward at positions different by 90 degrees in the radial direction. A tap of about 4 mm is formed in the central area of each projection 44. After rubber-based adhesive agent is coated on the surface of the flange 43, the holder 4 is attached to the bottom of the frame 5. A mounting hole is formed in the bottom of the frame at the position corresponding to each tap 45. The magnetic circuit on the holder 4 is fixed to the frame 5 by using screws 6 having a diameter of 4 mm as shown in FIG. 8. The frame 3 has an outer diameter of about 165 mm and a depth of about 20 mm, which is commonly called a 6.5-inch frame, and is made of a pressed aluminum frame having a thickness of 0.7 mm. The weight of the frame is about 40 gram-weight.

On the magnetic circuit constructed as above, the voice coil 1 shown in FIG. 1 was mounted to complete the loudspeaker shown in FIG. 8. The voice coil 1 had the bobbin 11 made of a PPTA film having a thickness of 0.05 mm about which bobbin the composite wire A was wound. The composite wire A was formed by the copper wire C1 made of the conductive material C and the magnetic material of Permalloy Fp provided on the whole surface of the copper wire C1. Namely, the composite wire A was formed by the copper wire C1 having a diameter of 0.21 mm, the Permalloy Fp plated on the surface of the copper wire C1 to a thickness of 10 μ, and the insulating material coated on the Permalloy Fp. The composite wire was wound about the bobbin 11 at the lower area thereof with the winding width of about 6 mm and the d.c. resistance of 3.43 ohms.

Figure 22:
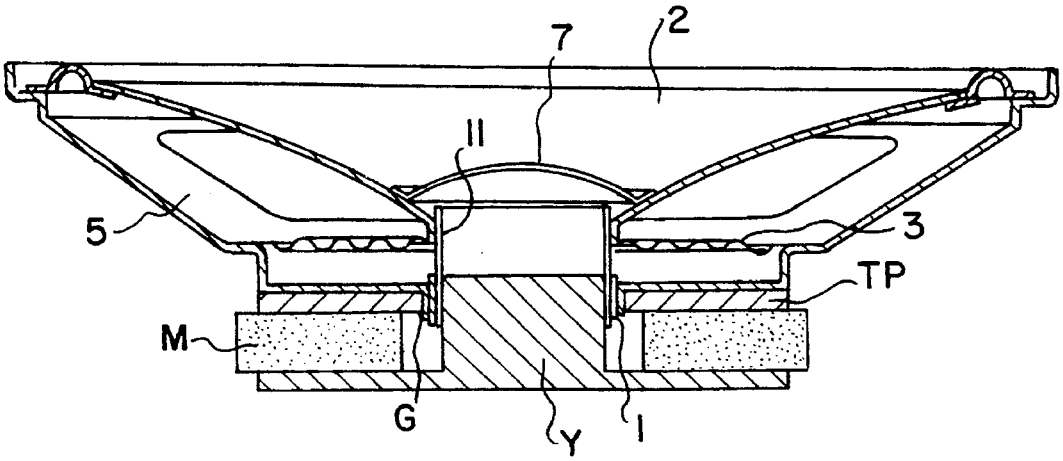
FIG. 22 PRIOR ART
FIG. 22 is a cross sectional view showing a conventional loudspeaker.
Figure 23:
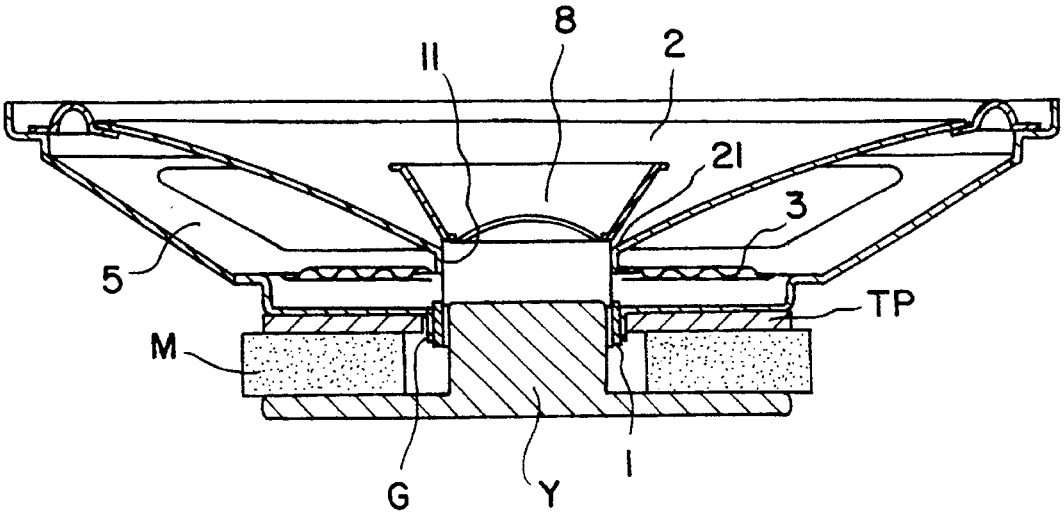
FIG. 23 PRIOR ART
FIG. 23 is a cross sectional view showing the structure of another conventional loudspeaker.
Figure 24:
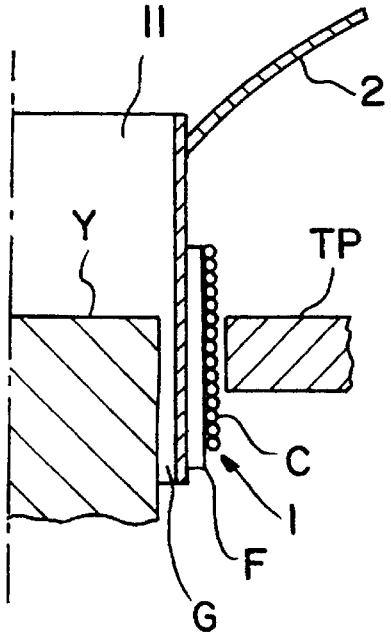
FIG. 24 PRIOR ART
FIG. 24 is a cross sectional view showing the main part of a conventional loudspeaker with a magnetic flat wire wound abut a bobbin.
Figure 25:
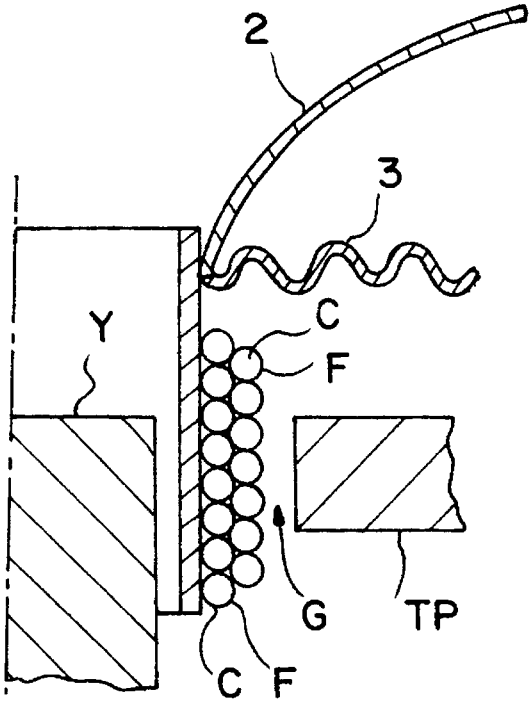
FIG. 25 PRIOR ART
FIG. 25 is a cross sectional view showing the main part of a conventional loudspeaker with a voice coil wire with magnetic powders mixed in the conductive material.
Figure 26:
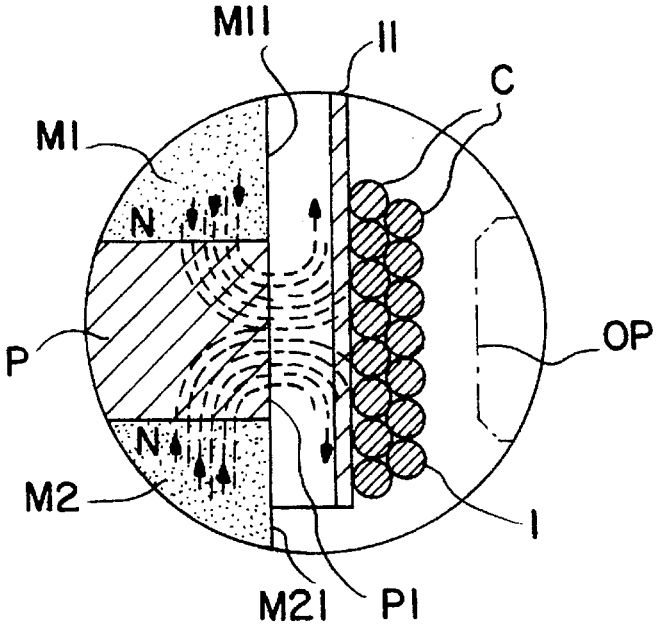
FIG. 26 PRIOR ART
FIG. 26 is a cross sectional view of a conventional loudspeaker of a repulsion magnetic field type.
Figure 27:
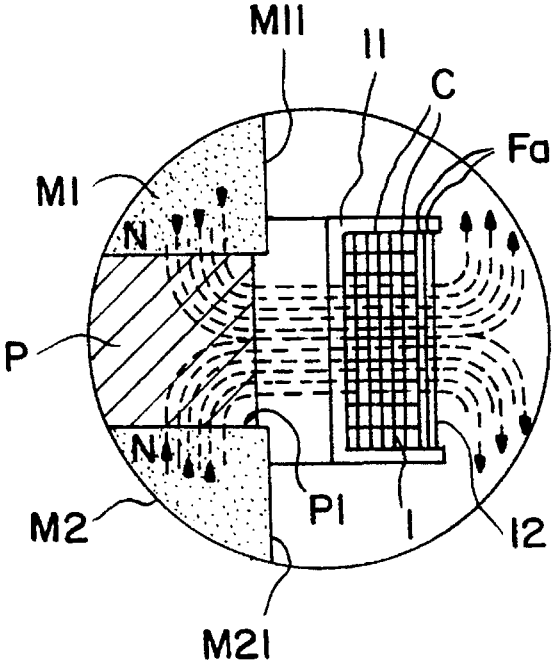
FIG. 27 PRIOR ART
FIG. 27 is a cross sectional view showing the structure of another conventional loudspeaker of a repulsion magnetic field type.

The magnetic circuit has no magnetic gap G, as opposed to the conventional loudspeakers shown in FIGS. 22 and 23 wherein a yoke Y and top plate TP are not used. However, the voice coil 1 itself has the magnetic flux transmission function so that fluxes shown by arrows in FIG. 8 can efficiently intersect the voice coil wire.

Used as the vibrating plate 2 was a cone vibrating plate made of pulp having an outer diameter of about 134 mm (inclusive of the edge), a neck diameter of 31 mm, and a depth of about 15 m. A general damper (suspension) 3 made of cotton cloth with phenol being impregnated and with corrugations and the like being thermally molded, was used as the damper (suspension) 3.

The vibrating plate 2 and damper 3 constructed as above were mounted on the assembly of the magnetic circuit and frame 5 to complete the loudspeaker. The measured characteristics of the loudspeaker shown in FIG. 8 are indicated by the solid line in FIG. 20.

For the purpose of comparison with the voice coil 1 made of the composite wire A, a general voice coil made of a copper wire C1 (diameter 0.21 mm) without the magnetic material was mounted on the loudspeaker same as the above embodiment. The measured characteristics of this loudspeaker are indicated by the broken line in FIG. 20.

Figure 20:
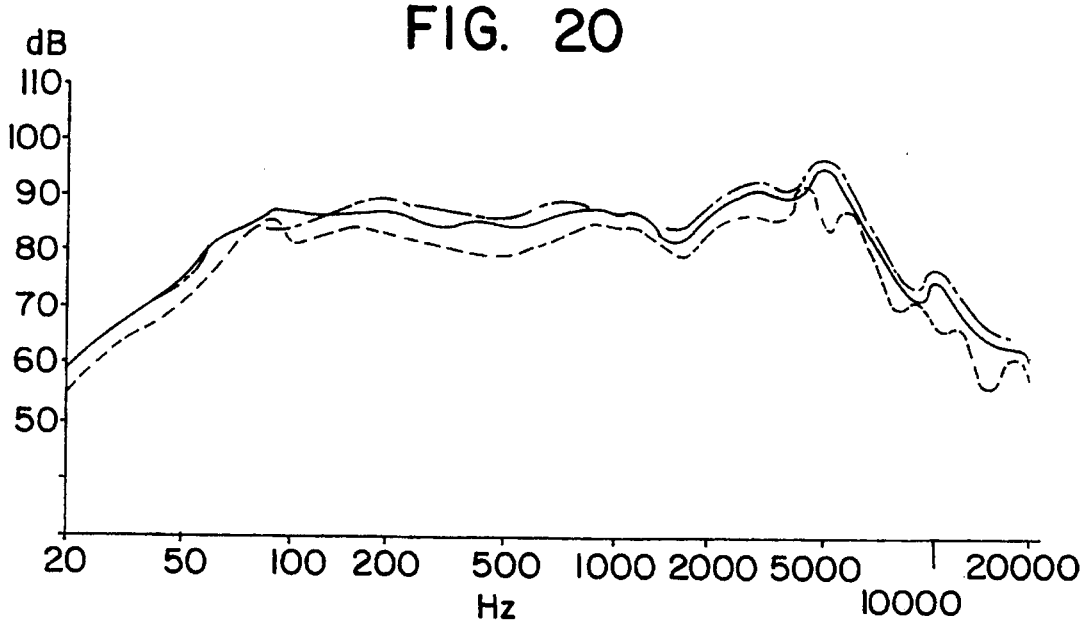
FIG. 20 is a graph comparing the frequency characteristics between the embodiment loudspeaker shown in FIG. 8 and a conventional loudspeaker.
Figure 21:
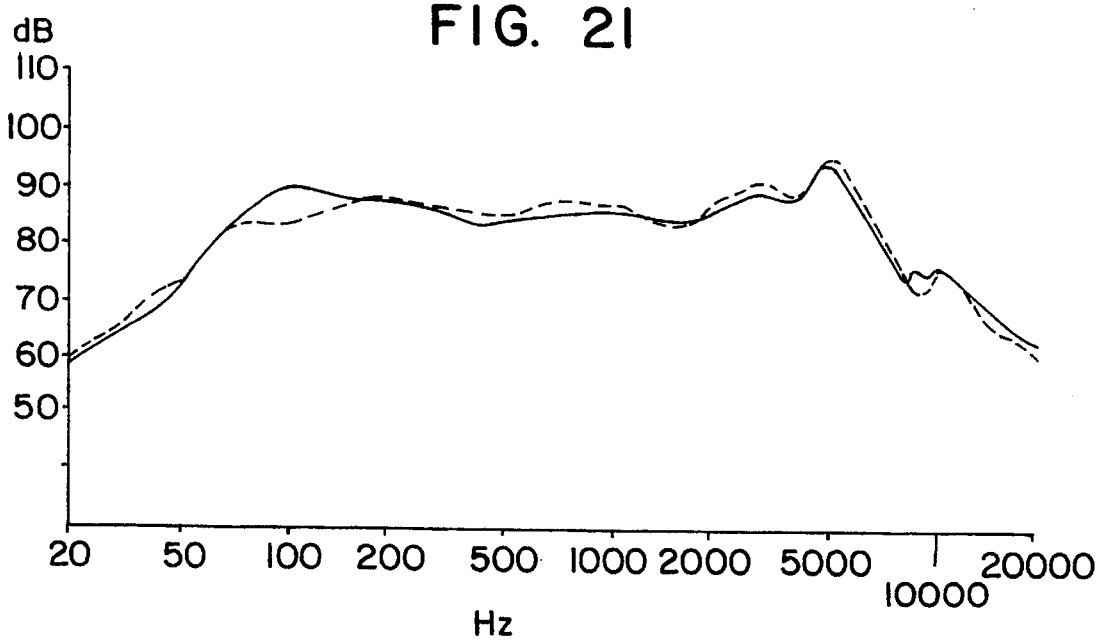
FIG. 21 is a graph comparing the frequency characteristics between the embodiment loudspeaker shown in FIG. 17 and a conventional loudspeaker.

The characteristics of the conventional loudspeaker of FIG. 22 having the voice coil 1 made of the copper wire and having a general magnetic gap without using the repulsive magnetic field, are indicated by the one-dot-chain line in FIG. 20. In this case, in order to use the same comparison conditions as much as possible, the vibrating system used was the same as the above embodiment, and the frame 5 used was the same as the above embodiment which is commonly used and made of a pressed iron plate having a thickness of 0.7 mm. The magnetic circuit used was also a general magnetic circuit assembled by a top plate TP (outer diameter of 75 mm, inner diameter of 32.25 mm, thickness of 4.5 mm), a ferrite magnet M (outer diameter of 85 mm, inner diameter of 45 mm, thickness of 13 mm), and a yoke Y (pole diameter of 29.95 mm, bottom outer diameter of 75 mm, height of about 20 mm).

As seen from the characteristics shown in FIG. 20, the comparison results showed that the loudspeaker using the composite wire A had an excellent sound pressure level as compared to the loudspeaker with a conventional voice coil wire operated in the repulsive magnetic field. As compared to a conventional loudspeaker using a ferrite magnet, the loudspeaker of the embodiment showed the practically usable characteristics although it showed some difference in the sound pressure level.

The weight of the loudspeaker of the embodiment shown in FIG. 8 was compared with that of the conventional loudspeaker. In the case of the loudspeaker of the embodiment, the weight of the magnetic circuit portion was about 83 gram-weight, the weight of the loudspeaker unit was 133 gram-weight, and the weight of the loudspeaker with the grille was about 218 gram-weight. In the case of the conventional loudspeaker, the weight of the magnetic circuit portion was 63 gram-weight, the weight of the loudspeaker unit was about 780 gram-weight, and the weight of the loudspeaker with the grille was 865 gram-weight. Namely, the weight of the loudspeaker of the embodiment was reduced greatly as compared to the conventional loudspeaker, by about 86% for the magnetic circuit, by about 83% for the loudspeaker unit, and by about 75% for the loudspeaker with the grille.

FIGS. 10 to 15 show examples of the structures of voice coils mounted on the magnetic circuit of a repulsive magnetic field type constructed as above, wherein various combinations of composite wires are used.

Figure 10:
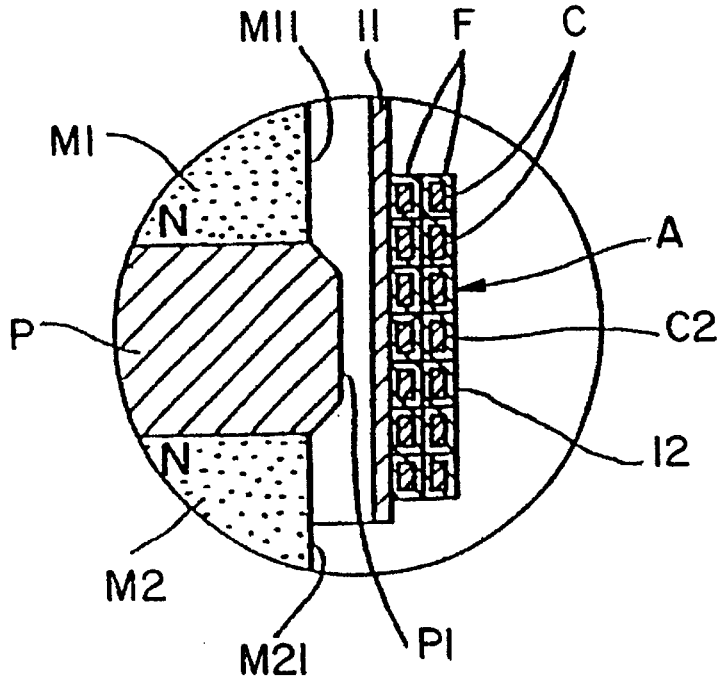
FIG. 10 is an enlarged cross sectional view showing an example of a voice coil to be used for the loudspeaker shown in FIG. 8.
Figure 11:
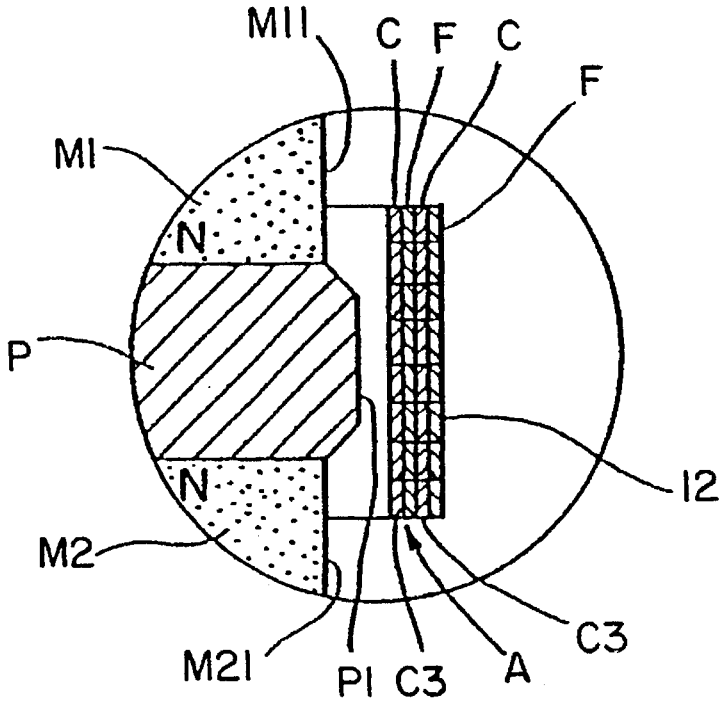
FIG. 11 is a cross sectional view showing the main part of another example of a voice coil to be used for the loudspeaker shown in FIG. 8.
Figure 12:
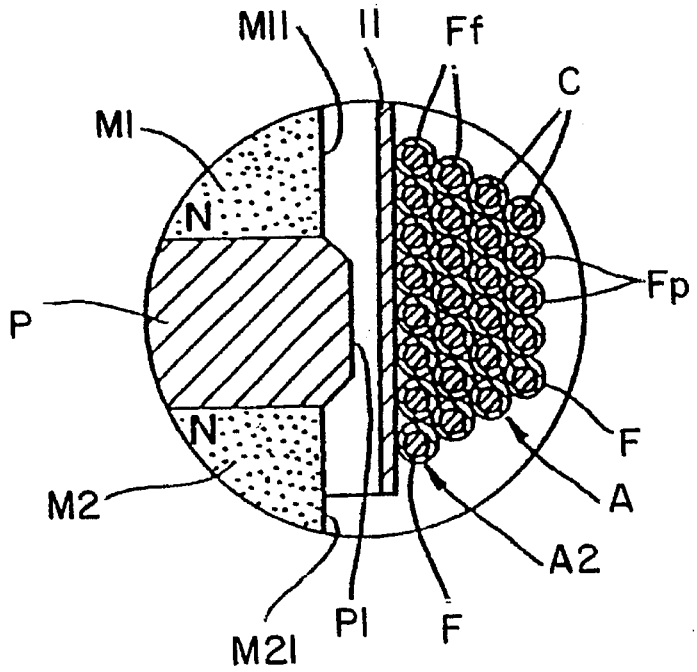
FIG. 12 is a cross sectional view showing the main part of another example of a voice coil to be used for the loudspeaker shown in FIG. 8, wherein composite wires having different materials are wound on different winding layers.

In the voice coil shown in FIG. 10, magnetic material F is provided on the whole surface of a flat wire C1 made of conductive material C. In the voice coil shown in FIG. 11, magnetic material F is provided on one side of a foil C3 made of conductive material, the foil is cut into stripe wires having a predetermined width which are then subjected to an insulating process. This voice coil is a bobbin-less structure.

In accordance with a particular application of a loudspeaker, the structure of the voice coil 1 maybe changed. Namely, the voice coil 1 may be formed by using winding layers each having a composite wire A of different magnetic material F. In the voice coil 1 shown in FIG. 12, a composite wire A formed by a core copper wire C1 and iron Ff as a clad is Wound on the first and second winding layers, and another composite wire A formed by a core copper wire C1 and Permalloy Fp as a clad is wound on the third and fourth winding layers.

Figure 13:
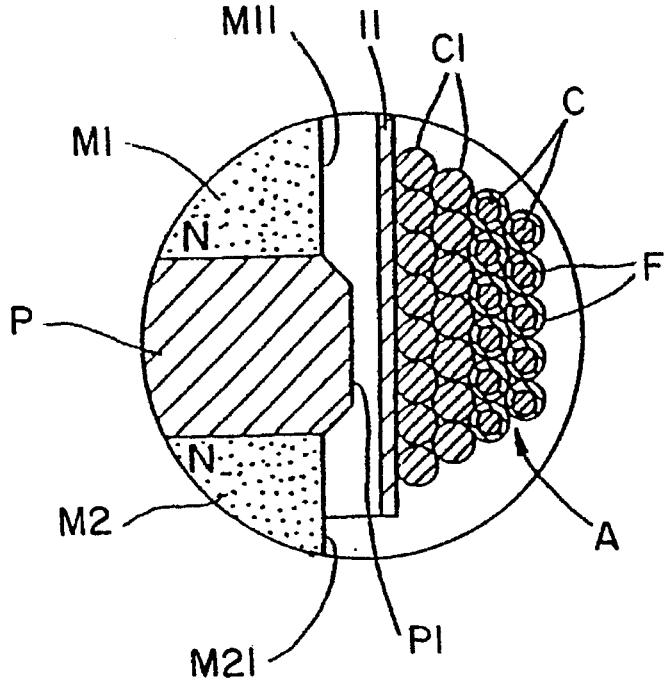
FIG. 13 is an enlarged cross sectional view showing the main part of another example of a voice coil to be used for the loudspeaker shown in FIG. 8, wherein a composite wire is partially used.

In the voice coil 1 shown in FIG. 13, a composite wire A is partially used. A general copper wire C1 is wound on the first and second winding layers, and a composite wire is wound on the third and fourth winding layers.

Figure 14:
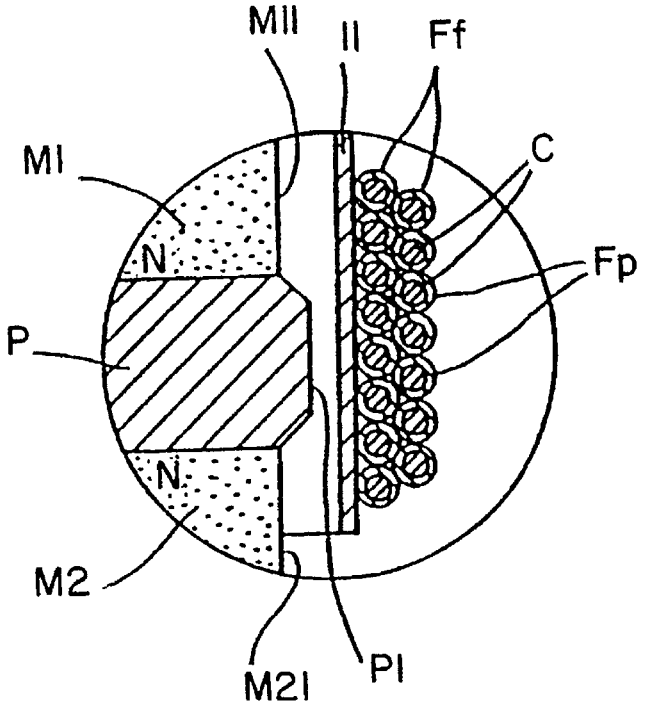
FIG. 14 is an-enlarged cross sectional view showing the main part of another example of a voice coil to be used for the loudspeaker shown in FIG. 8, wherein composite wires having different materials are wound alternately one turn after another.

In the voice coil 1 shown in FIG. 14, a plurality of voice coil wires are wound at the same time to dispose different voice coil wires alternately one turn after another. In this example, a composite wire A having iron Ff as the magnetic material F and another composite wire having Permalloy Fp as the magnetic material are wound at the same time to dispose different wires alternately one turn after another. In the voice coil shown in FIG. 15, a general wire made of conductive material C and a composite wire A are wound at the same time to dispose different wires alternately one turn after another.

Figure 16:
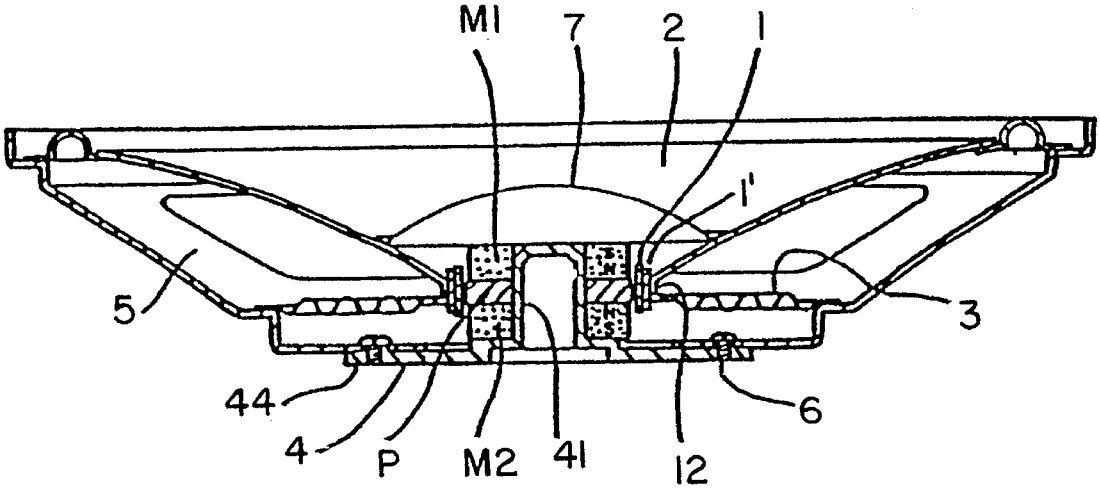
FIG. 16 is a cross sectional view showing another embodiment of a loudspeaker according to the present invention.

FIG. 16 shows another embodiment of the loudspeaker. In this embodiment, the bottom area of the magnetic circuit holder 4 shown in FIG. 2 is made shallow, the voice coil of a bobbin-less structure is used, and the vibrating plate 2 and the end of the suspension or damper 3 are directly bonded to the outer circumference 12 of the voice coil 1 by using adhesive agent. Specifically, a reinforcing member made of craft paper 1' or the like is wound about the outer circumference of the voice coil 1, the vibrating plate 2 and the end of the suspension are bonded to the craft paper, the craft paper 1' being used as a wiring board for the interconnection between lead wires and the voice coil. Accordingly, the weight of the loudspeaker of this embodiment is reduced by the weight of the voice coil bobbin 11 of the conventional loudspeaker and the loudspeaker shown in FIG. 8, and the voice coil 1 is positioned near the outer circumference of the center plate P, i.e. at the position where the magnetic material F receives a stronger magnetic field. As a result, the drive force of the voice coil 1 can be enhanced.

A voice coil of a bobbin-less structure can be manufactured by a conventional common method. Namely, a thin tape is attached to the outer surface of a tubular member made of aluminum or the like. The thermosetting adhesive agent used for bonding a composite wire is re-activated by using solvent or the like. This composite wire is then wound about the tubular member with the thin tape. The voice coil wire is thereafter thermally cured by thermally drying the tubular member, and dismounted from the tubular member. Finally, the thin tape left on the inner surface of the voice coil is removed.

In the structure of the loudspeaker shown in FIG. 16, the vibrating plate 2 and the end of the suspension or damper maybe attached to the upper or lower portion of the voice coil 1, without any problem. In the loudspeaker having such a structure, as seen from FIG. 16, the magnet M1 extends upward from the voice coil 1, leaving only a small gap between the outer circumference 11 of the magnet M1 and the inner surface of the dust cap or chamber 7. If the vibrating plate vibrates at a large amplitude, the inner surface of the dust cap 7 may contact the upper edge of the outer circumference 11 of the magnet M1, generating abnormal sounds. In such a case, the vibration stroke of the vibrating plate 2 is required to be restricted.

Figure 17:
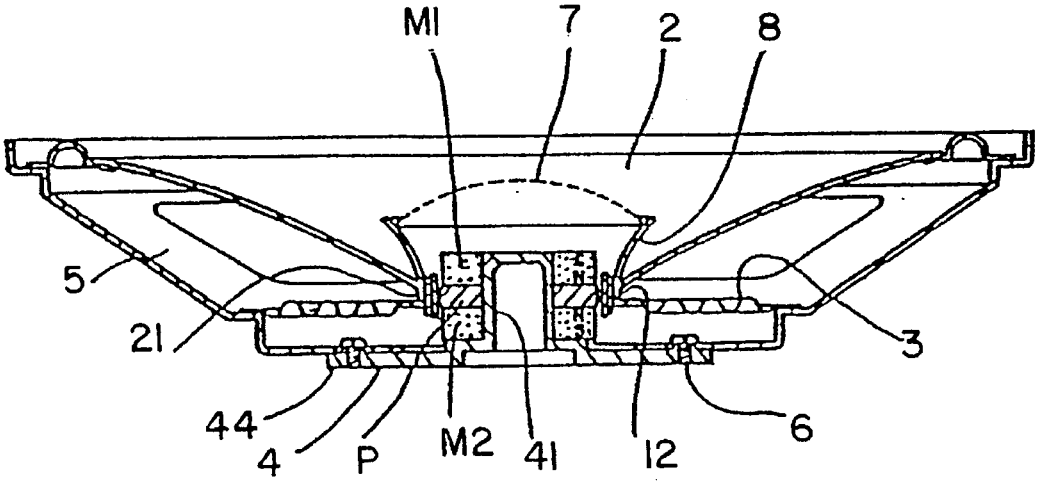
FIG. 17 is a cross sectional view showing an embodiment of a loudspeaker with a wither being mounted thereon.

Such a problem can be solved by the structure shown in FIG. 17, presenting even a better performance of the loudspeaker. In FIG. 17, reference numeral 8 represents a wither.

Specifically, the neck portion 21 of the vibrating plate 2 and the innermost circumference of the damper 3 are bonded to the voice coil outer circumference 12, the neck portion of the wither 8 is mounted on the voice coil outer circumference 12 above the neck portion 21, and the dust cap 7 is mounted near at the top of the wither 8. With this structure, the gap between the upper surface of the magnet M1 and the inner surface of the dust cap 7 can be made large. Therefore, even if the vibrating plate 2 vibrates at a large amplitude, the upper peripheral edge of the magnet M1 will not contact the inner surface of the dust cap 7.

The characteristics of the loudspeaker shown in FIG. 17 were measured by using the loudspeaker frame 5 and vibrating plate 2 having an inner diameter 30.4 mm same as the loudspeaker shown in FIG. 8. As the wither 8, a wither made of pulp having an outer diameter of about 50 mm, a neck diameter of about 31.5 mm, and a depth of about 11 mm was used. As the dust cap 7, a dust cover made of woven cloth with phenol being impregnated and thermally molded, was used. The measured result is indicated by the solid line in FIG. 21.

For the comparison purpose, the characteristics of the conventional loudspeaker shown in FIG. 23, i.e., the loudspeaker with the wither 8 and not using the repulsive magnetic field were measured. The size of this loudspeaker was set to the values same as the loudspeaker shown in FIG. 22 used for the comparison with the loudspeaker shown in FIG. 8. The vibrating plate 2 and damper 3 same as those of the conventional loudspeaker shown in FIG. 22 were used. The measured result is indicated by the broken line in FIG. 21.

As seen from the measured results, the loudspeaker of the embodiment shown in FIG. 17 showed the practically usable characteristics although it showed some difference in the sound pressure level as compared to a conventional loudspeaker using a ferrite magnet. In this embodiment, the dust cap is mounted above the wither 8. It is obvious that a chamber or the like may be used in place of the dust cap.

The weight of the loudspeaker of the embodiment shown in FIG. 17 was compared with that of the conventional loudspeaker shown in FIG. 23. In the case of the loudspeaker of the embodiment, the weight of the magnetic circuit portion was about 83 gram-weight, the weight of the loudspeaker unit was 133 gram-weight, and the weight of the loudspeaker with the grille was about 218 gram-weight. The weight of the loudspeaker of the embodiment was reduced greatly as compared to the conventional loudspeaker, by abut 86% for the magnetic circuit (603 gram-weight in the conventional case), by about 83% for the loudspeaker unit (780 gram-weight), and by about 75% for the loudspeaker with the grille (865 gram-weight ).

Figure 18:
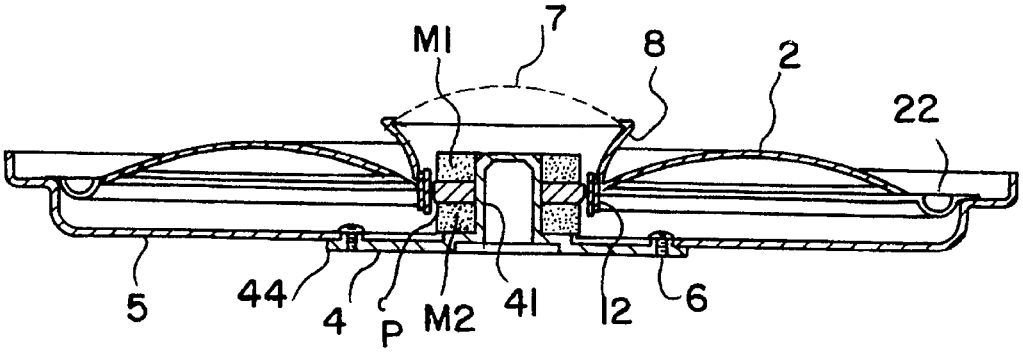
FIG. 18 is a cross sectional view showing another embodiment of a loudspeaker having a reduced weight.

A loudspeaker according to another embodiment has the structure shown in FIG. 18 aiming at reducing the weight as much as possible. In this embodiment, the loudspeaker frame 5 is of generally an inverted channel shape in section and extremely thin. The vibrating plate 2 is mounted on the frame 5 at its edge 22 without using a suspension 3 such as a damper. In this loudspeaker, the weight of the magnetic circuit portion was abut 83 gram-weight, the weight of the loudspeaker unit was about 125 gram-weight, and the weight of the loudspeaker with the grille was 210 gram-weight.

Figure 19:
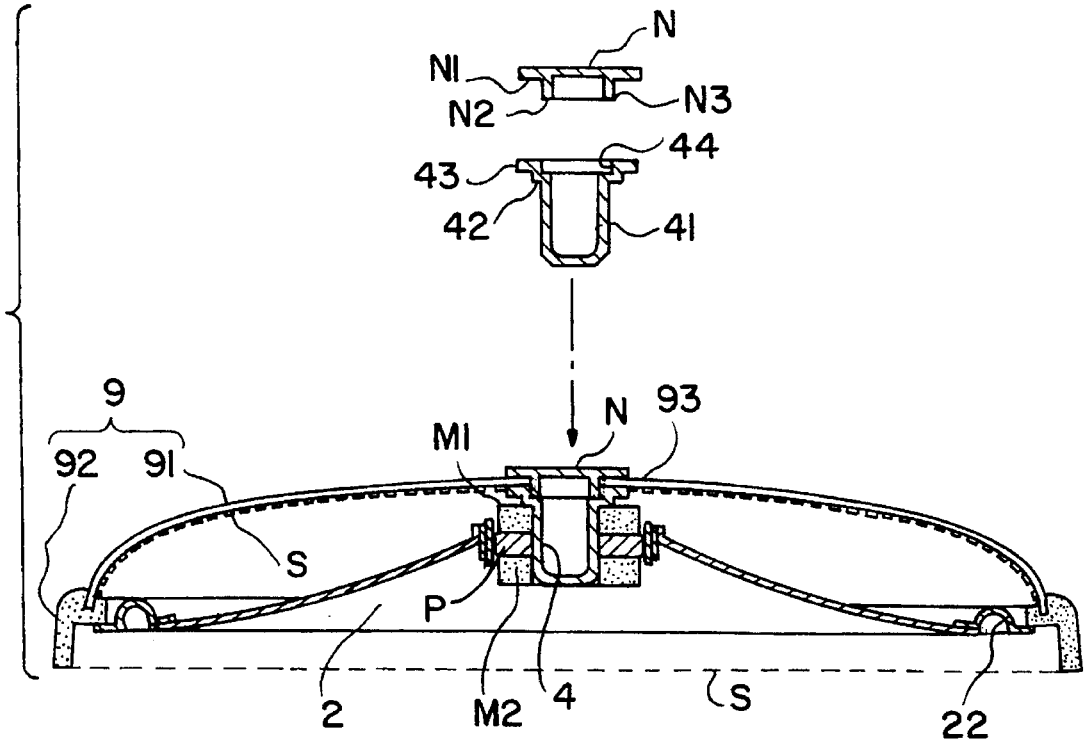
FIG. 19 is a cross sectional view showing another embodiment of a loudspeaker of a frame-less structure.

A loudspeaker according to another embodiment has the structure shown in FIG. 19, the weight being reduced more than the loudspeaker shown in FIG. 18. In this embodiment, without using a frame 5, the magnetic circuit portion and vibrating plate 2 are directly mounted on a loudspeaker grille 9 formed by a punched plate 91 and a grille support 92. In the magnetic circuit holder 4 having the center guide 41 with the same configuration as that shown in FIG. 2, the structures of the step 42 and flange 43 are modified in this embodiment. In the holder 4, the step 42 has an outer diameter of 16 mm and an inner diameter of 13 mm, with a thread 44 being formed in the inner wall of the step 42. The flange 43 has an outer diameter of 22 mm and a thickness of 2 mm. A nut N for mounting the holder 4 on the loudspeaker grille 9 is made of aluminum, and has a base portion N1 and a circular leg portion N2 forming a cap shape in section. A thread N3 is formed on the outer circumference of the circular leg portion N2, corresponding to the thread 44 of the holder 4. The circular leg portion N2 instead of a solid cylinder is used to reduce the weight of the nut N. The outer diameter of the base portion N1 is 22 mm and the thickness is 2 mm, like the flange 43.

Next, a method of assembling the magnetic circuit portion to the loudspeaker grille 9 will be described. The method of mounting the magnets M1 and M2 and the center plate P to the holder 4 is the same as described with FIG. 1. In mounting the magnetic circuit portion attached to the holder 4 on the loudspeaker grille 9, the circular leg portion N2 of the nut N is inserted into a mounting hole 93 of 13 mm in diameter formed at the apex area of the punched plate 91 of the loudspeaker grille 9. Adhesive agent is coated on the surface of the flange 43 of the holder 4. Then, the thread N44 of the holder is meshed with the thread N3 of the nut N by rotating either the holder 4 or the nut N so that the flange 43 and the nut circular leg portion N1 squeeze the punched plate 91. In this manner, the mounting is completed. The voice coil 1 is of a bobbin-less structure. The vibrating plate 2 is a cone vibrating plate made of pulp, and has an outer diameter of about 134 mm (inclusive of the edge), a neck diameter of 31.5 mm, and a depth of about 12 mm. The neck 21 of the vibrating plate 2 is mounted on the voice coil outer circumference 12 and the edge 22 is mounted on the inner bottom face of the grille support 92 in the opposite direction to the conventional direction, to thereby realizing a damperless structure. A woven cloth S for preventing dusts from entering is attached to the bottom surface of the punched plate 91 and the grille support 92.

In this embodiment, the weight of the magnetic circuit portion inclusive of the holder 4 was about 75 gram-weight. The weight of the loudspeaker itself is the total weight of the loudspeaker itself inclusive of the grille 9 because of no frame. The weight of the vibrating system and the magnetic circuit portion was 83 gram-weight, and the total weight inclusive of the grille 9 was about 168 gram weight. As compared to the conventional loudspeaker shown in FIG. 22, the weight of the loudspeaker of the embodiment was reduced greatly, by about 88% for the magnetic circuit (603 gram-weight in the conventional case), by about 89% for the loudspeaker unit (780 gram-weight), and by about 81% for the loudspeaker with the grille (865 gram-weight).

In this embodiment, the holder 4 is directly mounted on the punched plate 91, and the magnetic circuit portion is mounted by using the holder 4. Other mounting methods may also be used according to the design of the loudspeaker grille 9. In the above embodiment, the punched plate is made of iron. This plate may also be made of non-magnetic metal such as aluminum, synthetic resin, or the like, further reducing the weight.

Effects

According to the loudspeaker of the present invention, a composite wire formed by magnetic and conductive material is used for a voice coil. Therefore, a sound pressure as necessary and sufficient can be obtained without using an amorphous metal tape of the conventional loudspeaker. The work of manufacturing a voice coil can be performed in the conventional manner, without increasing the cost of coil winding.

In the case of a composite wire formed by conductive material such as a copper foil and magnetic material such as iron provided on one side of the conductive material, the efficiency of the loudspeaker can be improved by making the cross section of a coil wire rectangular or generally rectangular. The areas of magnetic and conductive materials or the kind of materials can be changed easily. It is therefore possible to manufacture relatively simply a voice coil capable of effectively using the magnetic fluxes. The ratio of magnetic material to conductive material can be adjusted in accordance with the conductivity and the coefficient of thermal expansion. As a result, even if voice coil wires of different materials are used as in a conventional loudspeaker, there is no peel-off between the voice coil wire and the voice coil bobbin and between voice coil wires.

In the case of a loudspeaker having a magnetic circuit with a repulsive magnetic field, use of composite wires as the voice coil wire allows magnetic fluxes to efficiently intersect the voice coil wire as indicated by arrows in FIG. 8. Namely, without forming a magnetic gap, the voice coil itself constitutes partially the magnetic circuit, thereby improving the drive force of the voice coil far greater than a conventional voice coil.

Since the magnetic gap is not necessary, the vibrating plate made of cone paper or the suspension such as a damper can be mounted on the voice coil at the outer circumference either at a lower or upper area thereof. Accordingly, the height of the loudspeaker including the magnetic circuit can be made low, thereby attaining both the reduced weight and thinned structure. This is particularly suitable for a loudspeaker to be mounted on a vehicle.

If the voice coil is made to have a bobbin-less structure, the weight of the loudspeaker can be reduced by the weight of the bobbin. In addition, the coil wire can be disposed near at the outer circumference of the center plate and the magnetic material can be positioned at the area where a stronger magnetic field is present, thereby increasing the drive force of the voice coil and improving the efficiency of the loudspeaker.

In this case, a wither may be mounted on the vibrating plate, giving some margin of the amplitude of the vibrating plate. If a wither is directly mounted on the outer circumference of the voice coil, as opposed to the conventional wither wherein it is driven via the voice coil bobbin, the transmission efficiency of the drive force from the voice coil, and hence the performance of the loudspeaker, can be improved considerably.

If the magnetic circuit portion and vibrating plate are directly mounted on the loudspeaker grille, the weight can be further reduced, allowing the total weight inclusive of the loudspeaker grill to be reduced by 81% or more. In addition, the mounting depth can be improved considerably as compared to the conventional depth to substantially zero depth. This is particularly suitable for a loudspeaker to be mounted on a vehicle.

If a punched plate of a loudspeaker grille is made of non-magnetic metal such as aluminum or synthetic resin, the magnetic flux distribution of the magnetic circuit becomes uniform improving the performance of the loudspeaker. The non-magnetic metal such as aluminum is effective for reducing the weight and for the heat dissipation, thereby further improving the performance.

We claim:

1. A loudspeaker comprising a voice coil having a rigid bobbin-less structure, said voice coil is of a self-sustained wound wire layer, a magnetic circuit for generating a repulsion magnetic field to drive the voice coil, the magnetic circuit being constituted by disposing two magnets (M1, M2) magnetized in the direction of thickness with the same polarities facing each other and by sandwiching a center plate made of magnetic material between said magnets, a vibrating plate and a voice coil suspension, wherein said voice coil is disposed on the outer side of said center plate in said repulsion magnetic field and the inner edge of said vibrating plate and/or said suspension is attached onto the outer surface of said voice coil wire layer, said magnetic circuit is fixed by a holder which passes through apertures provided on said magnets and the center plate.

2. A loudspeaker according to claim 1, wherein a wither is mounted directly onto said voice coil wire layer.

* * * * *